US006762004B2

(12) United States Patent
Yamanaka et al.

(10) Patent No.: US 6,762,004 B2
(45) Date of Patent: Jul. 13, 2004

(54) CHARGE CONTROL AGENT AND TONER FOR DEVELOPING ELECTROSTATIC IMAGES

(75) Inventors: Shun-ichiro Yamanaka, Osaka (JP); Akihide Isoda, Osaka (JP)

(73) Assignee: Orient Chemical Industries, Ltd., Osaka (JP)

( * ) Notice: Subject to any disclaimer, the term of this patent is extended or adjusted under 35 U.S.C. 154(b) by 0 days.

(21) Appl. No.: 10/242,038

(22) Filed: Sep. 11, 2002

(65) Prior Publication Data

US 2003/0104298 A1 Jun. 5, 2003

Related U.S. Application Data

(62) Division of application No. 09/400,327, filed on Sep. 21, 1999, now Pat. No. 6,534,231.

(30) Foreign Application Priority Data

Sep. 22, 1998 (JP) ..... 10-285941
Aug. 6, 1999 (JP) ..... 11-223322

(51) Int. Cl.[7] ..... G03G 9/097
(52) U.S. Cl. ..... 430/108.3; 430/108.1; 556/54; 556/181; 556/182; 556/464
(58) Field of Search ..... 430/108.1, 108.3; 556/54, 182, 181, 464

(56) References Cited

U.S. PATENT DOCUMENTS 5,736,289 A * 4/1998 Sukata et al. ..... 430/108.1
5,935,752 A * 8/1999 Ueda et al. ..... 430/108.1

OTHER PUBLICATIONS

Chemical Abstracts 125:11048x (Jul. 1, 1996).*

A New Syntesis of Tetrakis(C–methyl)octakis(hydroxyethyl)calyx[4]–resorcinarene via an Ethoxy–Tethered Trimethylsiloxy Precursor, by Ion Neda, et al., Verlag der Zeitschrift fuer Naturforschung, B: Chemical Science (1998), 53(8), pp. 841–848.*

"Functionalistation of C–undecylcalix[4]resorcinarene with Phosphorous–and Fluorin–Containing Substituents" by Vollbrecht et al., Phosphorous, Sulfur, and Silicon, (1995), vol. 107, pp. 173–179.*

Chemical Abstracts 125:11047w (1996).*

* cited by examiner

*Primary Examiner*—Christopher Rodee
(74) *Attorney, Agent, or Firm*—McGlew and Tuttle, P.C.

(57) ABSTRACT

Charge control agent and toner for developing electrostatic images containing said charge control agent. The active ingredient of the charge control agent is a metal compound obtainable by reacting one or two or more molecules of a compound having a phenolic hydroxy group and one or two or more molecules of a metal alkoxide.

12 Claims, No Drawings

CHARGE CONTROL AGENT AND TONER FOR DEVELOPING ELECTROSTATIC IMAGES

CROSS-REFERENCE TO RELATED APPLICATION

This application is a division of U.S. application Ser. No. 09/400,327 filed Sep. 21, 1999, now U.S. Pat. No. 6,534,231 dated Mar. 18, 2003, and the entire disclosure of such prior application is considered to be part of the disclosure of the instant application and is hereby incorporated by reference herein.

BACKGROUND OF THE INVENTION

1. Field of the Invention

The present invention relates to a toner for developing electrostatic latent images in electrophotography, electrostatic recording, electrostatic printing, etc., and a charge control agent capable of controlling the amount of charges of said toner.

2. Description of the Prior Art

In copying machines, printers and other instruments based on electrophotography, various toners containing a coloring agent, a fixing resin and other substances are used to visualize the electrostatic latent image formed on the photoreceptor having a light-sensitive layer containing an organic or inorganic photoconductive substance. Such toners are required to show satisfactory performance in terms of chargeability, fixability, offset resistance, etc. Toner chargeability is a key factor in electrostatic latent image-developing systems. Thus, to appropriately control the chargeability of a toner, a charge control agent providing a positive or negative charge is often added to the toner.

In recent years, to achieve image quality improvement, while copying and printing speeds are increased, there have been increased demands for improved charge characteristics of toners, such as increased charge rise speeds, and for toner fixability on recording papers, such as excellent low-temperature fixability and offset resistance. Such demands for improved toner performance are intensifying with the advance in performance sophistication of copying machines and printers.

As charge control agents and charge control auxiliaries coping with these problems, a toner including eight phenol derivatives is disclosed in Japanese Patent Unexamined Publication No. 266462/1988. Also, Japanese Patent Unexamined Publication No. 230163/1990 discloses a toner containing a compound obtainable by dimerizing salicylic acid or a derivative thereof using a ligand group. Japanese Patent Unexamined Publication Nos. 237467/1991 and 139456/1992 disclose toners each containing an oligomer obtainable by condensing a particular p-phenylphenol compound and formaldehyde. Furthermore, Japanese Patent Unexamined Publication Nos. 216277/1993 and 216278/1993 disclose toners each containing a phenol derivative. Also, Japanese Patent Unexamined Publication No. 166691/1996 discloses a toner containing a condensed cyclic compound of a resorcinol and aldehyde.

However, the developers incorporating these toners remain unsatisfactory in terms of charge characteristics.

The present invention is directed to provide a charge control agent wherein the active ingredient is a compound having an excellent charge control property and a stable chemical structure, which is sharp in charge amount distribution, high in charge amount uniformity, excellent in general-purpose applicability (colorlessness or color lightness) and charge rise property, low in environmental dependency, and excellent in toner durability in multiple repeated use, and which does not adversely affect toner fixability and offset property when used in toners; and a toner for developing electrostatic images incorporating said charge control agent.

SUMMARY OF THE INVENTION (1-1) The charge control agent of the present invention comprises as an active ingredient a metal compound obtainable by reacting one or two or more molecules of a compound having a phenolic hydroxy group and one or two or more molecules of a metal alkoxide. In this specification, "metal" includes "semimetal" which is exemplified by Si, etc.

This reaction is a reaction between a phenolic hydroxy group (—OH) and a metal alkoxide ($M(OR)_n$); the H of the phenolic hydroxy group (—OH) and some or all of the alkoxy groups (—OR) in the metal alkoxide cooperatively produce and liberate a corresponding alcohol (ROH) to metallize the phenolic hydroxy group.

The aforementioned metal alkoxide may be one represented by $M(OR)_n$ [in this formula, M is a metal, R is a linear or branched alkyl group, and n is an integer of 2–4].

(1-2) The charge control agent of the present invention contains as an active ingredient a metal compound represented by General Formula [I] below.

$$(Af)_x(Ld)_y \qquad [I]$$

[In General Formula I], each of x and y, whether identical or not, is an integer of 1 or 2 or more.

Af is a compound containing one or two or more aromatic hydrocarbon rings, each of which rings has one or two or more phenolic hydroxy groups or has no phenolic hydroxy groups; provided that when x is 2 or more, all Af are identical or some or all of them are mutually different.

Ld is $(—O—)_rM(OR)_s$, wherein M is a metal, OR is an alkoxy group, r is an integer of 1 or more, s is an integer of 0 or more, and the sum of r and s is 1 or more; provided that when y is 2 or more, all Ld are identical or some or all of them are mutually different. In different embodiments, one or two or more of r, M, R and s are mutually different.

Each Ld is bound to one or two or more aromatic hydrocarbon rings in Af via the aforementioned —O—; each Af is bound with one or more Ld; provided that when x is 2 or more, all Af are bound together via Ld.

The metal compound represented by General Formula [I] above can be obtainable by reacting one or two or more molecules of a compound having a phenolic hydroxy group and one or two or more molecules of a metal alkoxide.

With respect to the above formula, r is an integer of 1–4, s is an integer of 0–3, and the sum of r and s is 2–4; each Ld may be bound to 1–4 Af via —O—.

(2-1) In (1-1), the alkoxy group (OR) in the metal alkoxide is preferably a linear or branched alkoxy group having 1–8 carbon atoms (e.g., methoxy, ethoxy, propoxy, butoxy, pentyloxy, hexyloxy, nonyloxy, octyloxy).

(2-2) In (1-2), R is preferably a linear or branched alkyl group having 1–8 carbon atoms (e.g., methyl, ethyl, propyl, isopropyl, n-butyl, tert-butyl, isoamyl, octyl, tert-octyl, 2-ethylhexyl).

(3-1) The charge control agent of (1-1) or (2-1) is preferably a compound wherein at least one of the compounds having a phenolic hydroxy group has two or more aromatic hydrocarbon rings, such as benzene or naphthalene rings each having a phenolic hydroxy group, in its molecular structure.

(3-2) The charge control agent of (1-2) or (2-2) is preferably one wherein at least one of the Af contains two or more aromatic hydrocarbon rings, such as benzene or naphthalene rings to each of which a phenolic hydroxy group and/or Ld is bound.

(4-1) The charge control agent of (1-1), (2-1) or (3-1) is preferably a compound wherein at least one of the compounds each having a phenolic hydroxy group has three or more aromatic hydrocarbon rings, such as benzene or naphthalene rings each having a phenolic hydroxy group, in its molecular structure.

(4-2) The charge control agent of (1-2), (2-2) or (3-2) is preferably one wherein at least one of the Af contains three or more aromatic hydrocarbon rings, such as benzene or naphthalene rings to each of which a phenolic hydroxy group and/or Ld is bound.

(5-1) The charge control agent of (1-1), (2-1), (3-1) or (4-1) is preferably one wherein the compound having a phenolic hydroxy group is one or two or more selected from the group consisting of calixarenes or derivatives thereof, acyclic compounds obtainable by condensing phenols and aldehydes or derivatives of said acyclic compounds (these acyclic compounds may be phenolic resins), calixresorcinarenes or derivatives thereof, bisphenols or derivatives thereof, and compounds obtainable by condensing bisphenols and aldehydes.

(5-2) The charge control agent of (1-2), (2-2), (3-2) or (4-2) is preferably one wherein Af is one or two or more selected from the group consisting of calixarenes or derivatives thereof, acyclic compounds obtainable by condensing phenols and aldehydes or derivatives of said acyclic compounds (these acyclic compounds may be phenolic resins), calixresorcinarenes or derivatives thereof, bisphenols or derivatives thereof, and condensates of bisphenols or derivatives thereof and aldehydes or derivatives of said condensates.

(6) The M in (1-1), (2-1), (3-1), (4-1), (5-1), (1-2), (2-2), (3-2), (4-2) or (5-2) is preferably one or two or more metals selected from the group consisting of Ti, Al, Zr, Mg and Si.

(7) The toner of the present invention for developing electrostatic images contains the charge control agent of (1-1), (2-1), (3-1), (4-1), (5-1), (1-2), (2-2), (3-2), (4-2), (5-2) or (6).

The charge control agent of the present invention is well dispersible in resins, possesses excellent charge control characteristics, excellent in thermal stability and durability, and exhibits excellent environmental independency. In addition, it is unlikely to adversely affect toner fixability and offset characteristic when used in toners, and because it is colorless or light in color, it is unlikely to cause color tone damage when used in various toners, electrostatic resin powder paints, etc. It can also preferably be used in frictional charge-providing elements for providing a positive charge for a toner. Furthermore, the charge control agent of the present invention can be produced at low costs with recycled use of unreacted portions, used solvents, etc.

The toner of the present invention for developing electrostatic images is excellent in charge stability, environmental resistance, storage stability, thermal stability and durability, and good in fixability and offset characteristic.

DETAILED DESCRIPTION OF THE INVENTION

The metal compound serving as the active ingredient of the charge control agent of the present invention may consist of a single component or a mixture of two or more components. Specifically, it may be any one of the metal compounds represented by General Formula [I] or a mixture of two or more thereof.

The aforementioned compound having a phenolic hydroxy group and the Af in General Formula [I] above may comprise two or more aromatic hydrocarbon rings having or not having one or two or more substituents, which aromatic hydrocarbon rings bind together via —$CR^aR^b$— or —$SO_2$—.

Examples of substituents for such aromatic hydrocarbon rings include hydroxy groups;

branched or non-branched alkyl groups having 1–12 carbon atoms; —$CR^cHOH$ [$R^c$ is H (hydrogen), a branched or non-branched alkyl group having 1–12 carbon atoms, or a phenyl group having or not having a substituent (e.g., alkyl groups having 1–8 carbon atoms, or hydroxy groups)];

phenyl groups having or not having a substituent (e.g., alkyl groups having 1–8 carbon atoms, or hydroxy groups);

alkoxy groups (e.g., those having 1–12 carbon atoms);

alicyclic groups such as cycloalkyls (e.g., those having 1–8 carbon atoms), including cyclohexyl, cycloheptyl and cyclooctyl;

branched or non-branched alkenyl groups (e.g., those having 1–8 carbon atoms) such as vinyl, propenyl, butenyl and isobutenyl; and aralkyl groups such as benzyl groups, α, α-dimethylbenzyl groups, phenethyl groups and naphthylalkyl groups.

Each of $R^a$ and $R^b$ above, whether identical or not, is H (hydrogen); a branched or non-branched alkyl group having 1–12 carbon atoms; a perfluoroalkyl group having 1–12 carbon atoms; or a phenyl group having or not having a substituent (e.g., alkyl groups having 1–8 carbon atoms, or hydroxy groups).

Each Ld in General Formula [I] above may be bound to an aromatic hydrocarbon ring in one or two or more Af via the aforementioned —O— alone.

The metal compound serving as the active ingredient of the charge control agent of the present invention can be obtained by metallizing a compound having a phenolic hydroxy group by a known method using a metal alkoxide. The metal compound obtainable by this reaction takes various forms, depending on reaction mixture charge ratio of the phenol component (compound having a phenolic hydroxy group) and the metal alkoxide, reaction conditions, and other factors. For example, by choosing appropriate reaction conditions for the reaction of the compound having a phenolic hydroxy group and the metal alkoxide, the binding of the metal alkoxide with the phenolic hydroxy group in the compound having the phenolic hydroxy group can occur in various modes.

Specifically, when the reaction takes place between one molecule of $M(OR)_n$ and one —OH group in the compound having a phenolic hydroxy group, the metal M would have one —O— bond and (n−1) —OR bond(s). The compound having a phenolic hydroxy group may be a compound having one hydroxy group or a compound having two or more hydroxy groups. As the number of alkoxy groups in the metal alkoxide to react with the hydroxy group of the compound having a phenolic hydroxy group increases, the number of alkoxy groups bound to said metal M decreases; when n —OH groups react with $M(OR)_n$, $M(—O—)_n$ is produced. This reaction is exemplified by the following formulas ① through ③.

$$(Af\text{-}OH)+M(OR)_n \rightarrow Af\text{-}O—M(OR)_{n-1} \quad ①$$

$$[Af\text{-}(OH_2)]+M(OR)_n \rightarrow Af(—O—)_2M(OR)_{n-2} \quad ②$$

$$[Af\text{-}OH_n]+M(OR)_n \rightarrow Af(—O—)_n\ M \quad ③$$

The reaction of the compound having a phenolic hydroxy group and the metal alkoxide, and the reaction product metal compound, which serves as the active ingredient of the charge control agent of the present invention, are exemplified by (a), (b) and (c) below.

(a) Metal compounds wherein one or two or more molecules of a metal alkoxide are bound to one molecule of a compound having a phenolic hydroxy group, resulting from a reaction of one or two or more —OH groups in one molecule of the compound having the phenolic hydroxy group and one or two or more molecules of the metal alkoxide $M(OR)_n$.

(b) Metal compounds wherein two or more molecules of a compound having a phenolic hydroxy group are bound via —O—M—O— with one or two or more molecules of a metal alkoxide locating at the center, resulting from a reaction of one or two or more —OH groups in each of two or more molecules of the compound having the phenolic hydroxy group and one or two or more molecules of the metal alkoxide $M(OR)_n$. There are two cases where two or more molecules of a metal alkoxide are involved: all metal alkoxide molecules are bound with the same compounds having a phenolic hydroxy group in one case, and not all metal alkoxide molecules are bound with the same compounds having a phenolic hydroxy group in the other case.

In this case, compounds having a phenolic hydroxy group, which are bound together with a metal alkoxide located at the center, may include phenolic hydroxy group having compounds to which a metal alkoxide is bound in mode (a) above.

(c) Metal compounds comprising three or more molecules of a compound having a phenolic hydroxy group bound together in a chain (may be branched) via —O—M—O— with a metal alkoxide between the phenolic hydroxy group having compounds, resulting from a reaction of one or two or more —OH groups in each of the three or more molecules of the compound having a phenolic hydroxy group and two or more molecules of the metal alkoxide $M(OR)_n$. In this case, compounds having phenolic hydroxy group, bound in a chain via a metal alkoxide, may include phenolic hydroxy group having compounds to which a metal alkoxide is bound in mode (a) above, and/or phenolic hydroxy group having compounds bound together with a metal alkoxide located at the center in mode (b) above.

References giving synthesis examples for metal compounds (active ingredient of the charge control agent of the present invention) resulting from reactions of a compound having a phenolic hydroxy group and a metal alkoxide, and outlines thereof are shown below, which are not to be construed as limitative on the present invention, including production methods.

1) Chem. Ber. 1995, 128, 221–227.

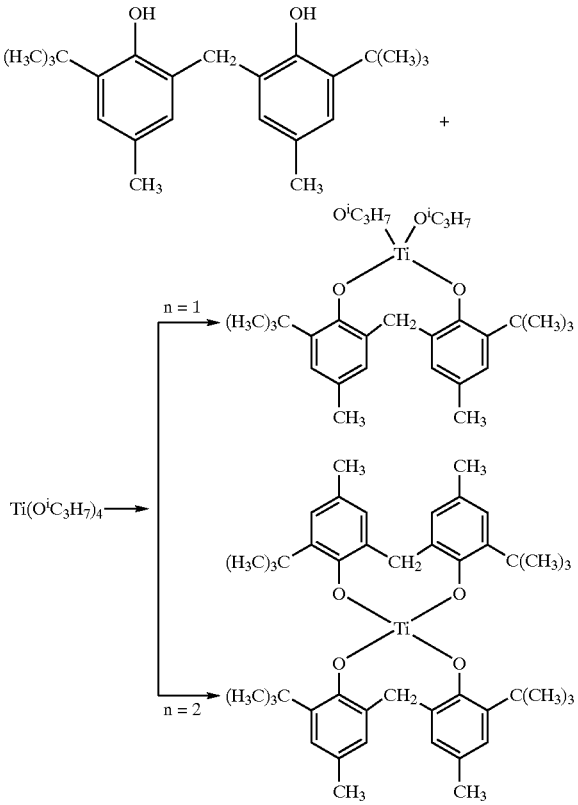

2) J. Am. Chem. Soc., 1990, 112, 8843–8851.

$$\text{Calixarene}+Ti(O\text{-iso-}C_3H_7)_4 \rightarrow \text{calix Ti complex mixture}$$

Representative metal compounds (active ingredient of the charge control agent of the present invention) resulting from a reaction of a compound having a phenolic hydroxy group and a metal alkoxide are shown by the following briefly schematized structural formulas, which are not to be construed as limitative on the present invention, including production methods.

$$G(OH)_m + p[M(OR)_n] \dashrightarrow$$

$$(HO)_{m-p}G[—O—M(OR)_{n-1}]_p$$

$$(HO)_{m-2p}G[\begin{matrix} —O \\ \diagdown \\ M(OR)_{n-2} \\ \diagup \\ —O \end{matrix}]_p$$

-continued

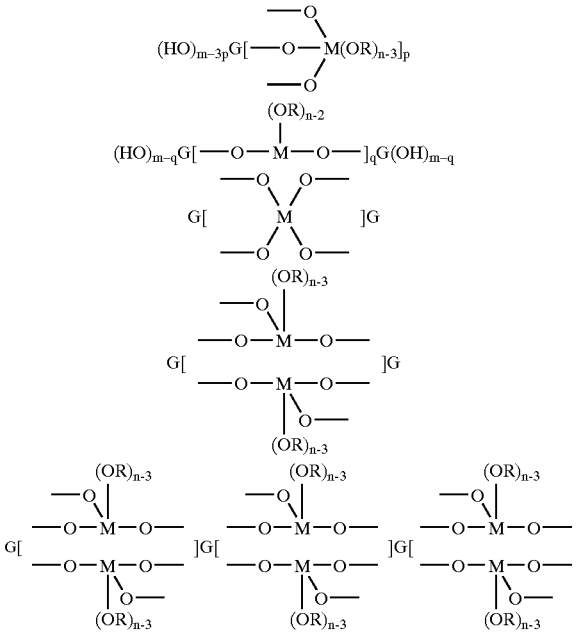

In the above formulas, each of m, p and q is an integer of 1 or more. The formula $G(OH)_m$ represents a compound having m phenolic hydroxy groups in the molecular structure, and is exemplified by calixarenes, phenol resins, calixresorcinarenes, bisphenols and bisphenol-aldehyde condensates. This formula does not exclusively mean that m hydroxy groups are present as substituents on a single benzene or naphthalene ring.

Examples of such metal compounds (active ingredient of the charge control agent of the present invention) (Example Compounds 1 through 35) are shown below, which are not to be construed as limitative on the present invention.

TABLE 1

| Example Compound | $Ex(OH)_m$ | M(OR)n | mol ratio $[Ex(OH)_m:M(OR)n]$ |
|---|---|---|---|
| 1 | CA1 | $Ti(OiPr)_4$ | 1:3 |
| 2 | CA1 | $Ti(OiPr)_4$ | 1:2 |
| 3 | CA4 | $Ti(OiPr)_4$ | 1:1 |
| 4 | PF1 | $Ti(OiPr)_4$ | 1:2 |
| 5 | PF8 | $Ti(OiPr)_4$ | 1:2 |
| 6 | PF15 | $Ti(OiPr)_4$ | 1:1 |
| 7 | BS4 | $Ti(OiPr)_4$ | 2:1 |
| 8 | BS2 | $Ti(OiPr)_4$ | 1:1 |
| 9 | BA4 | $Zr(OC_2H_5)_4$ | 1:2 |
| 10 | CA1 | $Zr(OC_2H_5)_4$ | 1:2 |
| 11 | CS4 | $Zr(OC_2H_5)_4$ | 1:3 |
| 12 | PF5 | $Zr(OC_2H_5)_4$ | 1:2 |
| 13 | BS1 | $Zr(OC_2H_5)_4$ | 2:1 |
| 14 | CA9 | $Al(OiPr)_3$ | 1:2 |
| 15 | CA3 | $Al(OiPr)_3$ | 1:3 |
| 16 | CA12 | $Al(OiPr)_3$ | 1:3 |
| 17 | CS10 | $Al(OiPr)_3$ | 2:1 |
| 18 | PF8 | $Al(OiPr)_3$ | 1:3 |
| 19 | PF11 | $Al(OiPr)_3$ | 1:2 |
| 20 | BS6 | $Al(OiPr)_3$ | 5:2 |
| 21 | BS7 | $Al(OiPr)_3$ | 3:2 |
| 22 | CS1 | $Mg(OC_2H_5)_2$ | 1:4 |
| 23 | CA3 | $Mg(OC_2H_5)_2$ | 1:2 |
| 24 | CS8 | $Mg(OC_2H_5)_2$ | 1:2 |
| 25 | PF20 | $Mg(OC_2H_5)_2$ | 2:3 |
| 26 | CA13 | $Mg(OC_2H_5)_2$ | 1:3 |
| 27 | CS5 | $Mg(OC_2H_5)_2$ | 1:2 |
| 28 | CA1 | $Si(OC_2H_5)_4$ | 1:2 |
| 29 | PF15 | $Si(OC_2H_5)_4$ | 1:3 |
| 30 | CA12 | $Si(OCH_3)_4$ | 1:2 |

Table 1, $Ex(OH)_m$ is a compound having a phenolic hydroxy group (examples given below), and OiPr is O—CH $(CH_3)_2$.

Example Compound 31

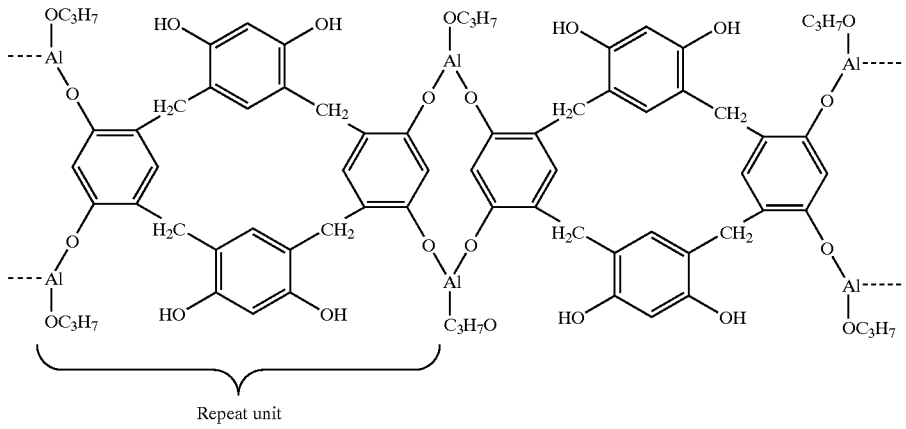

Example Compound 31 has a given number of repeat units in sequence.
Example Compound 32
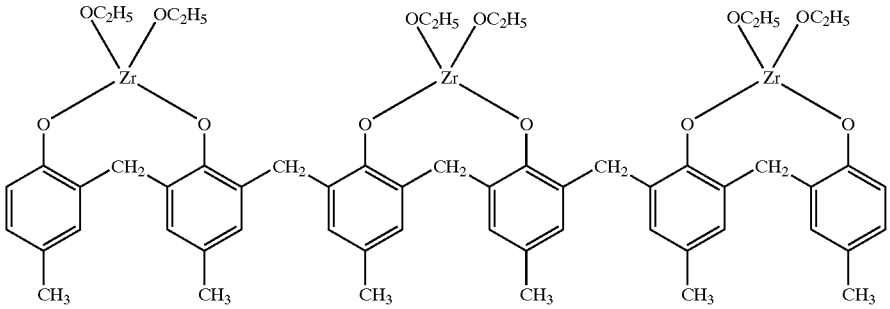
Example Compound 33
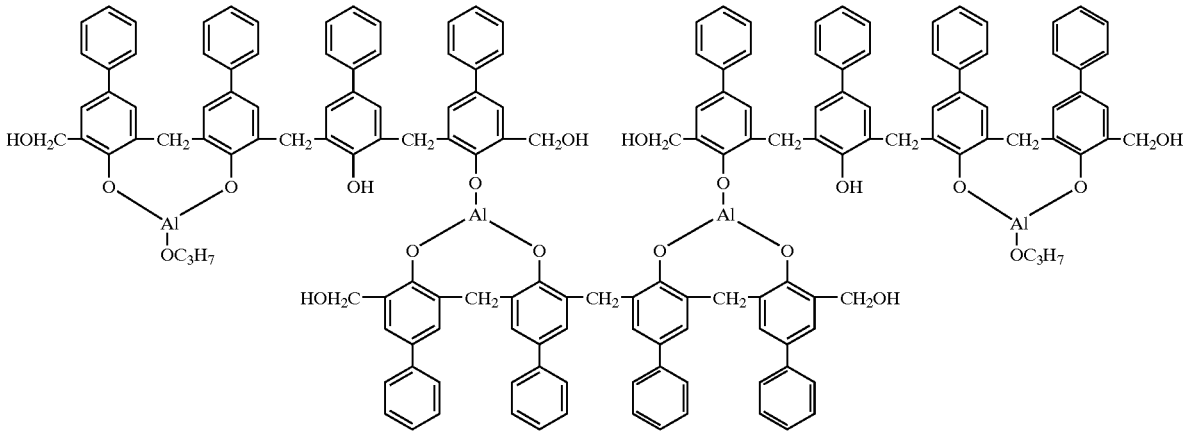
Example Compound 34
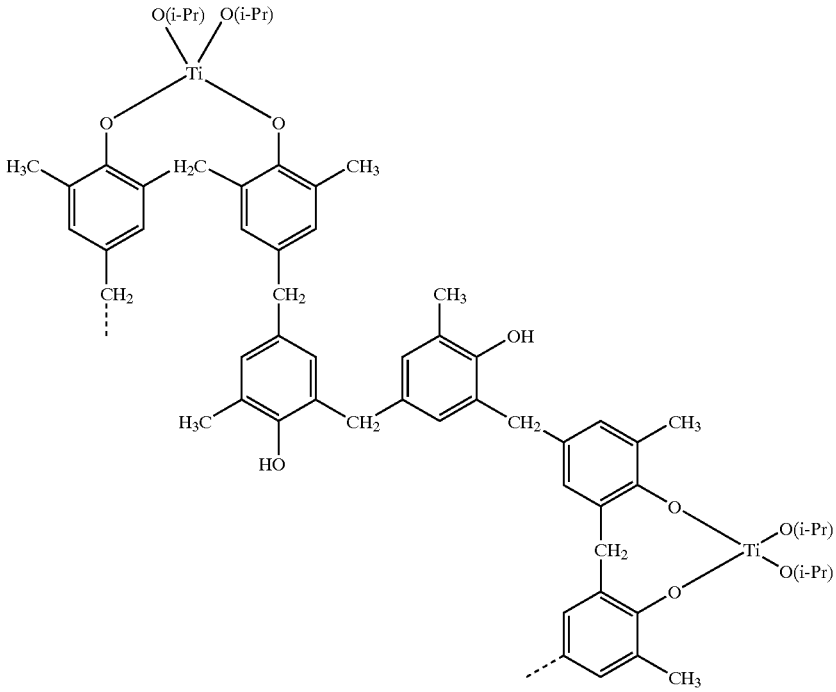

In Example Compound 34, i-Pr is an isopropyl group, and the dotted line indicates that the same structure is repeated via —$CH_2$—.

Example Compound 35

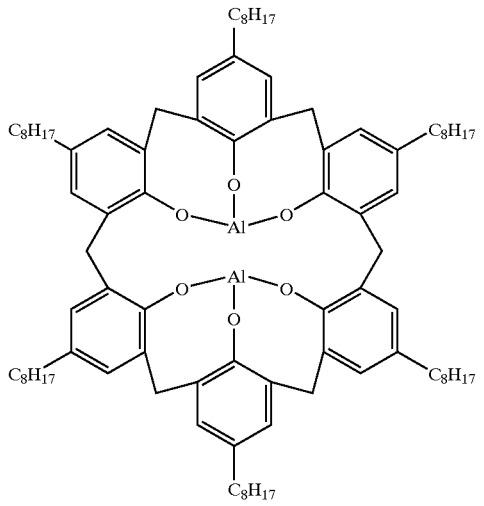

Although the metal alkoxide compound described above may be of any type, it is preferably a metal alkoxide represented by $M(OR)_n$ (in this formula, R is a linear or branched alkyl group having 1–8 carbon atoms, preferably 1–4 carbon atoms; M is a metal, preferably a metal selected from among Ti, Zr, Al, Mg, Si, etc.; n is an integer of 2–4).

Examples of metal alkoxides include the following alkoxides of the Al, Mg, Ti, Zr and Si series.

Al-series alkoxides: alkoxyaluminums such as aluminum n-propoxide, aluminum isopropoxide, t-butoxyaluminum and aluminum ethoxide.

Mg-series alkoxides: alkoxymagnesiums such as magnesium ethoxide, magnesium methoxide, magnesium butoxide and magnesium isopropoxide.

Ti-series alkoxides: alkoxytitaniums such as n-propoxytitanium, isopropoxytitanium and n-butoxytitanium.

Zr-series alkoxides: alkoxyzirconiums such as n-propoxyzirconium, ethoxyzirconium, isopropoxyzirconium and butoxyzirconium.

Si-series alkoxides: alkoxysilanes such as ethoxysilane, methoxysilane, butoxysilane and isopropoxysilane.

In the reaction for obtaining a metal compound (active ingredient of the charge control agent of the present invention), the use of the same alcohol as that liberated by the reaction of a metal alkoxide and a phenolic hydroxy group, as the reaction solvent, enables production cost reduction without environmental pollution because the reaction solvent is easily recyclable and because its discharge out of the reaction system is almost null theoretically (it should be noted, however, that the reaction solvent is not limited to such ones). An example scheme of such a reaction is shown below.

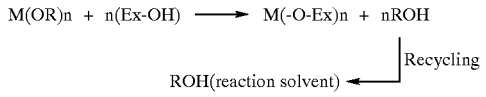

In the above scheme, n(Ex-OH) is n molecules of a compound having a phenolic hydroxy group; M, R and n have the same definitions as those given above.

Any compound having a phenolic hydroxy group can be used for the reaction for obtaining a metal compound (active ingredient of the charge control agent of the present invention), as long as it has a phenolic hydroxy group therein. Preferred examples thereof are cyclic reaction products resulting from a reaction of a compound having a phenolic hydroxy group and an aldehyde, or derivatives thereof, e.g., ⓪ the calixarenes or derivatives thereof shown below, ② the calixresorcinarenes or derivatives thereof shown below, ③ the acyclic compounds obtainable by condensing phenols and aldehydes or derivatives thereof (including phenol resins such as phenol-formaldehyde resin) shown below, (④ the bisphenols or derivatives thereof shown below, and ⑤) the reaction condensates of bisphenols or derivatives thereof and aldehydes or derivatives of said condensates shown below.

6) Calixarenes or Derivatives Thereof

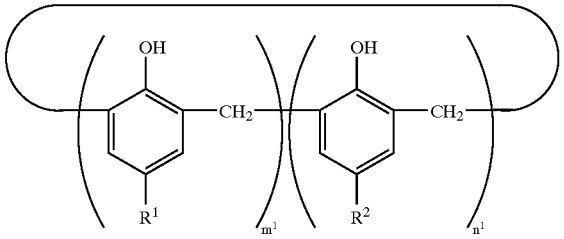

In the above formula, each of $R^1$ and $R^2$, whether identical or not, is H (hydrogen); a branched or non-branched alkyl group having 1–12 carbon atoms; a phenyl group having or not having a substituent (e.g., alkyl groups having 1–8 carbon atoms, or hydroxy groups); an alkoxy group (e.g., those having 1–12 carbon atoms); an alicyclic group such as a cycloalkyl (e.g., those having 1–8 carbon atoms), including cyclohexyl, cycloheptyl and cyclooctyl; a branched or non-branched alkenyl group (e.g., those having 1–8 carbon atoms) such as vinyl, propenyl, butenyl or isobutenyl; or an aralkyl group such as benzyl group, α, α-dimethylbenzyl group, phenethyl group or naphthylalkyl group.

Each of $m^1$ and $n^1$ is an integer of 0–8, the sum of $m^1$ and $n^1$ being 3–8. Note that the order of binding of the repeat unit in parenthesis with $R^1$ and that with $R^2$ may be any given order.

Examples thereof (Example Compounds CA1 through CA14) are shown below, which are not to be construed as limitative on the present invention.

TABLE 2

| Example Compound | $R^1$ | $m^1$ | $R^2$ | $n^1$ |
|---|---|---|---|---|
| CA1 | t-$C_4H_9$ | 8 | — | — |
| CA2 | t-$C_4H_9$ | 4 | — | — |
| CA3 | t-$C_4H_9$ | 6 | — | — |
| CA4 | Phenyl | 8 | — | — |
| CA5 | Phenyl | 6 | — | — |
| CA6 | $OCH_3$ | 8 | — | — |

TABLE 2-continued

| Example Compound | $R^1$ | $m^1$ | $R^2$ | $n^1$ |
|---|---|---|---|---|
| CA7 | $C_9H_{17}$ | 8 | — | — |
| CA8 | Cyclohexyl | 8 | — | — |
| CA9 | Phenylisopropyl | 8 | — | — |
| CA10 | $CH_3$ | 6 | — | — |

Example Compound CA1

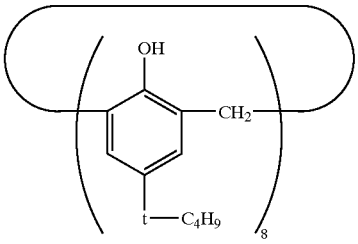

Example Compound CA4

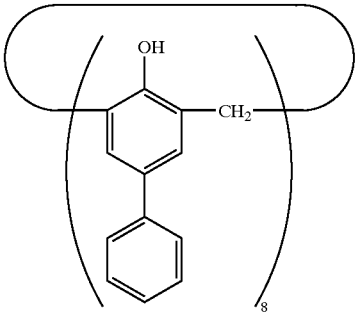

Example Compounds CA11 through CA14 are mixtures wherein the sum of $m^1$ and $n^1$ is 3–8.

TABLE 3

| Example Compound | $R^1$ | $R^2$ |
|---|---|---|
| CA11 | t-$C_4H_9$ | Phenyl |
| CA12 | t-$C_4H_9$ | $C_8H_{17}$ |
| CA13 | $CH_3$ | Phenyl |
| CA14 | t-$C_4H_9$ | $OCH_3$ |

Example Compound CA11

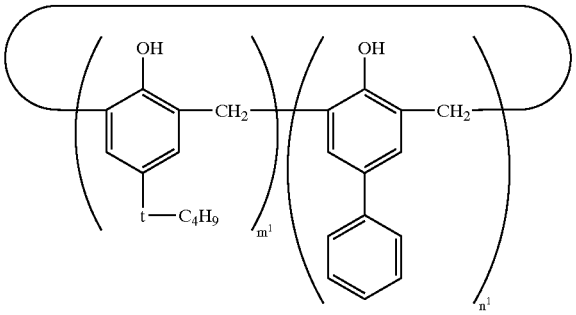

Example Compound CA12

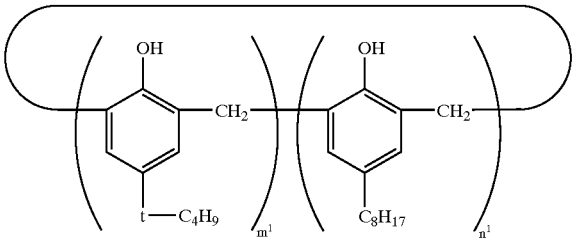

② Calixresorcinarenes or Derivatives Thereof

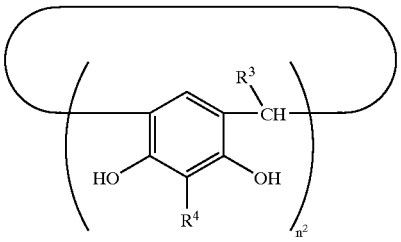

In this formula, $R^3$ is H (hydrogen); a branched or non-branched alkyl group having 1–12 carbon atoms; or a phenyl group having or not having a substituent (e.g., alkyl groups having 1–8 carbon atoms, or hydroxy groups), $R^4$ is H (hydrogen); a branched or non-branched alkyl group having 1–12 carbon atoms; a phenyl group having or not having a substituent (e.g., alkyl groups having 1–8 carbon atoms, or hydroxy groups); a hydroxy group; or a branched or non-branched alkenyl group (e.g., those having 1–8 carbon atoms) such as vinyl, propenyl, butenyl or isobutenyl, and $n^2$ is an integer of 3–8.

Examples thereof (Example Compounds CS1 through CS10) are shown below, which are not to be construed as limitative on the present invention.

TABLE 4

| Example Compound | $R^1$ | $R^4$ | $n^2$ |
|---|---|---|---|
| CS1 | H | $CH_3$ | 4 |
| CS2 | $C_3H_7$ | $CH_3$ | 4 |
| CS3 | Phenyl | H | 6 |

TABLE 4-continued

| Example Compound | $R^1$ | $R^4$ | $n^2$ |
|---|---|---|---|
| CS4 | $CH_3$ | H | 4 |
| CS5 | H | OH | 6 |
| CS6 | Phenyl | H | 4 |
| CS7 | Phenol | H | 4 |
| CS8 | H | OH | 4 |
| CS9 | $C_3H_7$ | Phenyl | 4 |
| CS10 | $C_6H_{13}$ | H | 4 |

Example Compound CS1

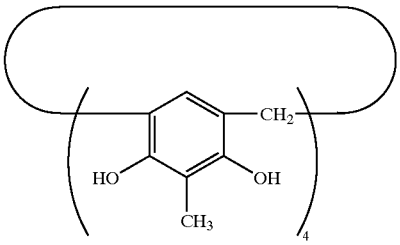

Example Compound CS3

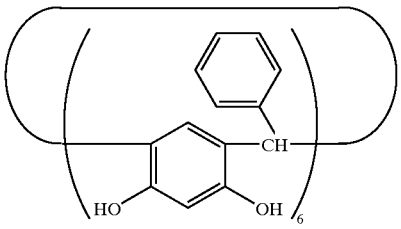

Example Compound CS9

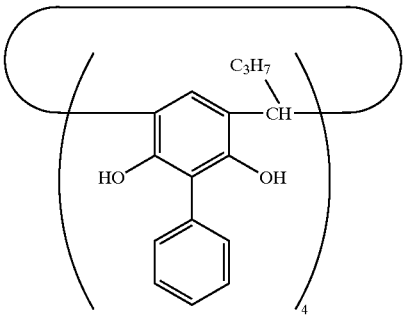

③ Acyclic Compounds Obtainable by Condensing Phenols and Aldehydes or Derivatives Thereof Examples of these compounds include acyclic compounds obtainable by condensing phenols and aldehydes (phenol-formaldehyde resins such as resole- or novolac-series phenol resins), rosin-modified phenol resins, terpene phenol resins, and resorcin-formalin resins.

Commercial products of these compounds are exemplified by the products listed below.

Acyclic compounds obtainable by condensing phenols and aldehydes: Resitop PS-2880 and PSM-6842, produced by Gun-ei Chemical Industry Co., Ltd.; TAL-101 and TAL-201, produced by Taoka Chemical Co., Ltd.; Tamanol 100S, 1010R, 510, 520S, AS, PA, 531, and 770, produced by Arakawa Chemical Industry Ltd.; BRP-441, 872, 5933, 8552, CKM-908, 5254, and 1634, produced by Showa Highpolymer Co., Ltd.; Hitanol 1133, 1135, 1140, 2100, 2181, and 2300N, produced by Hitachi Chemical Co., Ltd.

Rosin-modified phenol resins: Tespol 1202, 1203, and 1361, produced by Hitachi Kasei Polymer Co., Ltd.; Hariphenol 145G and P-110, produced by Harima Chemicals, Inc.; Tamanol 135, 145, and 340, produced by Arakawa Chemical Industry Ltd.; Polystar 2130, produced by Yasuhara Chemical Co., Ltd.

Terpene phenol resins: Tertac TI, produced by Japan Exlan Co., Ltd.; Tamanol 803L, produced by Arakawa Chemical Industry Ltd.

A preferred example is the phenol resin (phenol-formaldehyde resin) derivative represented by the general formula below:

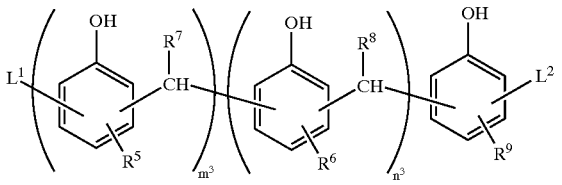

In this formula, each of $L^1$ and $L^2$, whether identical or not, is H (hydrogen); or —$CR^{10}HOH$;

each of $R^5$, $R^6$ and $R^9$, whether identical or not, is H (hydrogen); a branched or non-branched alkyl group having 1–12 carbon atoms; a phenyl group having or not having a substituent (e.g., alkyl groups having 1–8 carbon atoms, or hydroxy groups); an alkoxy group (e.g., those having 1–12 carbon atoms); an alicyclic group such as a cycloalkyl (e.g., those having 1–8 carbon atoms), including cyclohexyl, cycloheptyl and cyclooctyl; a branched or non-branched alkenyl group (e.g., those having 1–8 carbon atoms) such as vinyl, propenyl, butenyl or isobutenyl; or an aralkyl group such as benzyl group, α, α-dimethylbenzyl group, phenethyl group or naphthylalkyl group, the number of groups being 1–3 for each of $R^5$, $R^6$ and $R^9$.

Each of $R^7$, $R^8$ and $R^{10}$, whether identical or not, is H (hydrogen); a branched or non-branched alkyl group having 1–12 carbon atoms; or a phenyl group having or not having a substituent (e.g., alkyl groups having 1–8 carbon atoms, or hydroxy groups).

Each of $m^3$ and $n^3$ is an integer of 0–10, the sum of $m^3$ and $n^3$ being 2–10. Note that the order of binding of the repeat unit in parenthesis with $R^5$ and $R^7$ and that with $R^6$ and $R^8$ may be any given order.

Examples thereof (Example Compounds PF1 through PF20) are shown below, which are not to be construed as limitative on the present invention.

TABLE 5

| Example Compound | $R^5$ | $R^6$ | $R^7$ | $R^8$ | $R^9$ | $L^1$ | $L^2$ | $m^3$ | $n^3$ |
|---|---|---|---|---|---|---|---|---|---|
| PF1 | H | — | H | — | H | $CH_2OH$ | $CH_2OH$ | 2–4 | |
| PF2 | H | 4-$CH_3$ | H | H | 4-$CH_3$ | H | H | 1–2 | 1–3 |
| PF3 | H | — | $CH_3$ | — | H | $CH(CH_3)OH$ | $CH(CH_3)OH$ | 2–6 | |
| PF4 | H | 4-Phenyl | H | H | H | $CH_2OH$ | H | 1–2 | 1–2 |
| PF5 | 4-$CH_3$ | — | H | — | 4-$CH_3$ | H | H | 2–5 | |
| PF6 | 4-$CH_3$ | 4-Phenyl | H | H | 4-Phenyl | $CH_2OH$ | $CH_2OH$ | 1–7 | 1–2 |
| PF7 | 4-$CH_3$ | — | $C_3H_7$ | — | 4-$CH_3$ | H | $CH(CH_3H_7)OH$ | 2–5 | |
| PF8 | 2-$CH_3$ | — | H | — | 2-$CH_3$ | $CH_2OH$ | $CH_2OH$ | 2–8 | |
| PF9 | 2-$CH_3$ | $OCH_3$ | H | $CH_3$ | 2-$CH_3$ | $CH_2OH$ | $CH(CH_3)OH$ | 2–6 | 1–4 |
| PF10 | 2-$CH_3$ | 3,5-Dimethyl | H | $CH_3$ | 3,5-Dimethyl | H | H | 0–5 | 0–5 |
| PF11 | 2-$CH_3$ | 4-Phenyl | H | H | 2-$CH_3$ | $CH_2OH$ | $CH_2OH$ | 0–4 | 0–4 |
| PF12 | 2-$CH_3$ | 4-$CH_3$ | H | H | 2-$CH_3$ | H | H | 0–4 | 0–4 |
| PF13 | 2-$CH_3$ | — | H | — | 2-$CH_3$ | $CH(C_3H_7)OH$ | $CH(C_3H_7)OH$ | 2–8 | |
| PF14 | 3-$CH_3$ | — | Phenyl | — | 3-$CH_3$ | H | H | 2–10 | |
| PF15 | 4-Phenyl | — | H | — | 4-Phenyl | $CH_2OH$ | $CH_2OH$ | 2–9 | |
| PF16 | 4-Phenyl | — | $C_6H_{13}$ | — | 4-Phenyl | H | H | 2–8 | |
| PF17 | 2-Phenyl | — | H | — | 2-Phenyl | $CH_2OH$ | H | 2–7 | |
| PF18 | 3-Phenyl | — | H | — | 3-Phenyl | H | H | 2–8 | |
| PF19 | 3,5-Dimethyl | — | H | — | 3,5-Dimethyl | $CH_2OH$ | $CH_2OH$ | 2–8 | |
| PF20 | 4-t-$C_4H_9$ | — | H | — | 4-t-$C_4H_9$ | H | H | 2–8 | |

Example Compounds PF1 through PF20 are mixtures wherein either $m^3$ or both $m^3$ and $n^3$ fall within the respective ranges shown in Table 5.

Example Compound PF1

($m^3$=2)

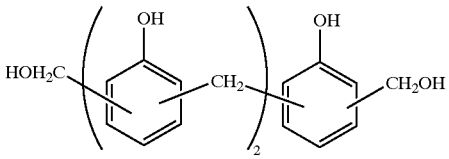

Example Compound PF4

($m^3$=2, $n^3$=1)

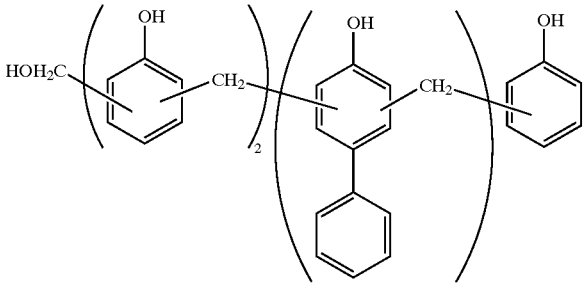

Example Compound PF9

($m^3$=6, $n^3$=4)

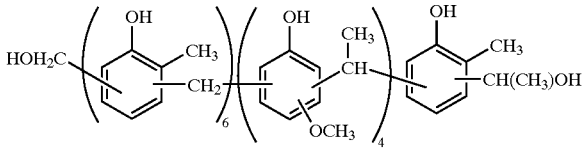

Example Compound PF12

($m^3$=2, $n^3$=4)

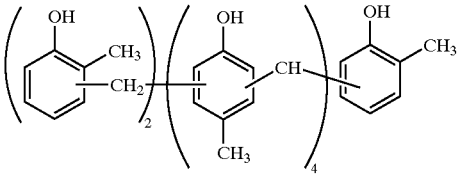

④ Bisphenols or Derivatives Thereof

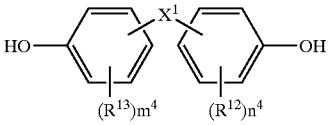

In this formula, $X^1$ is —$SO_2$— or —$CR^{15}R^{16}$— (each of $R^{15}$ and $R^{16}$ is H (hydrogen); or a branched or non-branched alkyl group having 1–12 carbon atoms; or a perfluoroalkyl group having 1–12 carbon atoms), each of $R^{11}$ and $R^{12}$, whether identical or not, is H (hydrogen); a hydroxy group; $CH_2OH$; a branched or non-branched alkyl group having 1–12 carbon atoms; a perfluoroalkyl group having 1–12 carbon atoms; an alkoxy group (e.g., those having 1–12 carbon atoms); an alicyclic group such as a cycloalkyl (e.g., those having 1–8 carbon atoms), including cyclohexyl, cycloheptyl and cyclooctyl; a branched or non-branched alkenyl group (e.g., those having 1–8 carbon atoms) such as vinyl, propenyl, butenyl or isobutenyl; or an aralkyl group such as benzyl group, α, α-dimethylbenzyl group, phenethyl group or naphthylalkyl group.

Each of $m^4$ and $n^4$ is an integer of 0–4.

Examples thereof (Example Compounds BS1 through BS6) are shown below, which are not to be construed as limitative on the present invention.

TABLE 6

| Example Compound | $R^{11}$ | $R^{12}$ | $X^1$ |
|---|---|---|---|
| BS1 | H | H | 4,4'-$C(CH_3)_2$— |
| BS2 | H | H | 4,4'-$SO_2$— |
| BS2 | H | H | 4,4'-$C(CF_3)_2$— |
| BS4 | H | H | 4,4'-$CH(C_3H_7)$— |
| BS5 | 2,4-Di-t-$C_4H_9$ | 2,4-Di-t-$C_4H_9$ | 4,4'-$CH(C_3H_7)$— |
| BS6 | 2,6-Di-t-$C_4H_9$ | 2,6-Di-t-$C_4H_9$ | 4,4'-$C(CH_3)_2$— |

Example Compound BS1

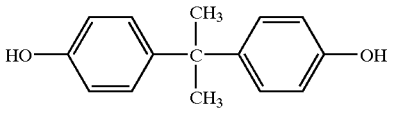

Example Compound BS2

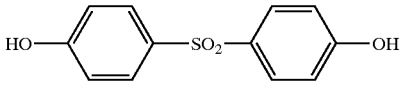

Example Compound BS6

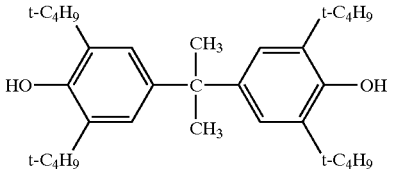

⑤ Reaction Condensates of Bisphenols or Derivatives Thereof and Aldehydes or Derivatives of Said Condensates

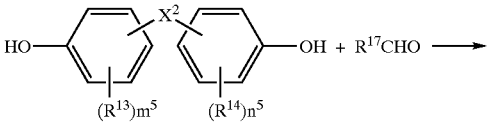

Condensate derivative of bisphenol and aldehyde

In this formula, $X^2$ is —$SO_2$— or —$CR^{18}R^{19}$— (each of $R^{18}$ and $R^{19}$ is H (hydrogen); or a branched or non-branched alkyl group having 1–12 carbon atoms; or a perfluoroalkyl group having 1–12 carbon atoms), each of $R^{13}$ and $R^{14}$, whether identical or not, is H (hydrogen); a hydroxy group; $CH_2OH$; a branched or non-branched alkyl group having 1–12 carbon atoms; a perfluoroalkyl group having 1–12 carbon atoms; an alkoxy group (e.g., those having 1–12 carbon atoms); an alicyclic group such as a cycloalkyl (e.g., those having 1–8 carbon atoms), including cyclohexyl, cycloheptyl and cyclooctyl; a branched or non-branched alkenyl group (e.g., those having 1–8 carbon atoms) such as vinyl, propenyl, butenyl or isobutenyl; or an aralkyl group such as benzyl group, α, α-dimethylbenzyl group, phenethyl group or naphthylalkyl group.

$R^{17}$ is H (hydrogen); a branched or non-branched alkyl group having 1–12 carbon atoms; or a phenyl group having or not having a substituent (e.g., alkyl groups having 1–8 carbon atoms, or hydroxy groups).

Each of $m^5$ and $n^5$ is an integer of 0–3.

In the reaction of a bisphenol and an aldehyde, resulting in the aforementioned compound, bisphenol units bind together via —$CH(R^{17})$— bonds. That is, in this case, the compounds having a phenolic hydroxy group include from those resulting from a reaction of two molecules of bisphenol and one molecule of aldehyde to polymers resulting from a reaction of multiple molecules of bisphenol and multiple molecules of aldehyde.

Examples thereof (Example Compounds BA1 through BA9) are shown below, which are not to be construed as limitative on the present invention.

TABLE 7

| Example Compound | $R^{13}$ | $R^{14}$ | $X^2$ | $R^{17}$ |
|---|---|---|---|---|
| BA1 | H | H | 4,4'-$C(CH_3)_2$— | H |
| BA2 | H | H | 4,4'-$SO_2$— | H |
| BA3 | H | H | 4,4'-$C(CF_3)_2$— | H |
| BA4 | 2-t-$C_4H_9$ | 2-t-$C_4H_9$ | 4,4'-$CH(C_3H_7)$— | H |
| BA5 | H | H | 4,4'-$CH(CH_3)_2$— | $CH_3$ |
| BA6 | H | H | 4,4'-$C(CH_3)_2$— | $C_6H_5$ |

Example Compound BA7

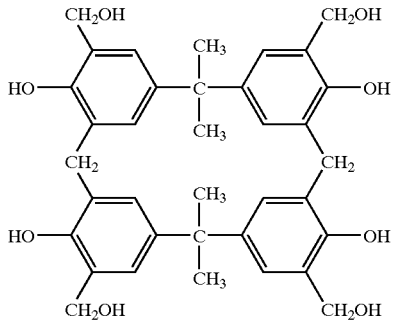

Example Compound BA8

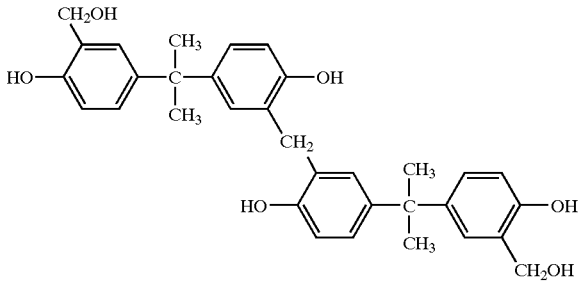

Example Compound BA9

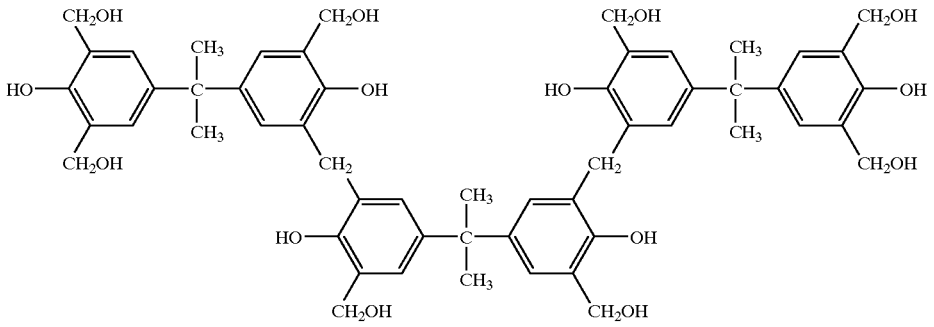

On the other hand, the toner of the present invention for developing electrostatic images may comprise the charge control agent of the present invention, a resin, and a coloring agent.

The toner of the present invention for developing electrostatic images may contain the charge control agent of the present invention in any amount, as long as the control of the charge of the toner is possible. Preferable amounts of the charge control agent of the present invention added are 0.1–10 parts by weight, more preferably 0.5–5 parts by weight, per 100 parts by weight of resin, based on the above-described metal compound (active ingredient of the charge control agent of the present invention).

Examples of resins useful in the toner of the present invention include the following known resins for toners or binder resins. Specifically, useful resins include styrene resin, styrene-acrylic resin, styrene-butadiene resin, styrene-maleic acid resin, styrene-vinyl methyl ether resin, styrene-methacrylic acid ester copolymer, phenol resin, epoxy resin, polyester resin, polypropylene resin, and paraffin wax. These resins may be used singly or in blends.

In the toner of the present invention, various dyes and pigments can be used as coloring agents. Examples of useful coloring agents include organic pigments such as Quinophthalone Yellow, Isoindolinone Yellow, Perynone Orange, Perylene Maroon, Rhodamine 6G Lake, Quinacridone Red, Rose Bengale, Copper Phthalocyanine Blue, Copper Phthalocyanine Green and diketopyrrolopyrrole pigments: inorganic pigments such as Carbon Black, Titanium White, Titanium Yellow, Ultramarine, Cobalt Blue and red iron oxide; various oil-soluble dyes and dispersion dyes such as azo dyes, quinophthalone dyes, anthraquinone dyes, phthalocyanine dyes, indophenol dyes and indoaniline dyes; and triarylmethane dyes and xanthene dyes modified with resins such as rosin, rosin-modified phenol or rosin-modified maleic acid.

In the toner of the present invention for developing electrostatic images, the above-mentioned coloring agents can be used singly or in combination of two or more kinds. Chromatic monocolor toners can incorporate as coloring agents appropriately mixed dyes and pigments of the same color, e.g., quinophthalone dyes and pigments, xanthene or rhodamine dyes and pigments, and phthalocyanine dyes and pigments.

Also, to improve toner quality, additives, e.g., electroconductive particles, fluidity-improving agents and image peeling inhibitors, can be added to the toner internally or externally.

The toner of the present invention for developing electrostatic images can, for example, be produced as described below. For example,a toner having a mean particle diameter of 1–15 $\mu$m can be obtainable by thoroughly mixing a resin as described above, a coloring agent, the charge control agent of the present invention, and, if necessary, a magnetic material, a fluidizing agent and other additives, using a ball mill or another mechanical mixer, subsequently kneading the mixture in a molten state using a hot kneader such as a heat roll, kneader or extruder, cooling and solidifying the mixture, then pulverizing the solid and classifying the resulting particles by size.

Other applicable methods include the method in which other starting materials are dispersed in a binder resin solution and subsequently spray dried to yield the desired toner, and the polymerizing toner production method in which a given set of starting materials are mixed in a monomer to constitute a binder resin to yield an emulsified suspension, which is then polymerized to yield the desired toner.

When the toner of the present invention for developing electrostatic images is used as a two-component developer, development can be achieved by the two-component magnetic brush developing process or the like using the toner in mixture with carrier powder.

Any known carrier can be used. Examples of the carrier include iron powder, nickel powder, ferrite powder and glass beads about 50–200 $\mu$m in particle diameter, and such materials as coated with acrylic acid ester copolymer, styrene-acrylic acid ester copolymer, styrene-methacrylic acid ester copolymer, silicone resin, polyamide resin, ethylene fluoride resin or the like.

When the toner of the present invention for developing electrostatic images is used as a one-component developer, an appropriate amount of fine powder of a ferromagnetic material such as iron powder, nickel powder or ferrite powder may be added and dispersed in preparing the toner as described above.

On the other hand, by adding the charge control agent of the present invention to a resin powder paint for electrostatic painting, the charge of the powder paint can be controlled or enhanced. Because resin powder paints for electrostatic painting containing the charge control agent of the present invention are excellent in heat resistance and good in charge enhancing characteristic, they exhibit high paint adhesion efficiency even without recycled use. Painting using such powder paints can be achieved by electrostatic powder painting methods such as the corona application method, the frictional charging method and the hybrid method.

It is also possible to obtain a frictional charge-providing element capable of providing a charge for a toner for developing electrostatic images by coating the surface of a carrier, a cylindrical sleeve of a toner transportation element or a doctor blade, with a metal compound serving as the active ingredient of the charge control agent of the present invention, by dipping, spraying, brush application or the like.

This frictional charge-providing element is suitable for use in color toners because the metal compound incorporated therein is colorless or light in color. In addition, it is capable of stably providing a positive charge for a loner and producing toner images of high quality comparable to that of initial images even after continuous copying. Also, this frictional charge-providing element may concurrently contain a small amount of an auxiliary positive charge-providing agent.

EXAMPLES

The present invention is hereinafter described in more detail by means of the following examples, which are not to be construed as limitative. In the description below, "part(s) by weight" is referred to as "part(s)" for short.

First, synthesis examples for the charge control agent of the present invention are described in Production Examples 1 through 6.

Production Example 1

Synthesis of Example Compound 2

After 12.98 g (0.01 mol) of t-butylcalix (8) arene (Example Compound CA1) was dispersed in 500 ml of isopropyl alcohol under stirring and thermal refluxing conditions for two hours, this dispersion liquid was allowed to cool to room temperature; 5.68 g (0.02 mol) of $Ti(i\text{-}C_3H_7O)_4$ was added drop by drop. After a reaction was carried out under refluxing conditions for 10 hours, the reaction mixture was allowed to cool to room temperature, distilled to remove the solvent, and dried under reduced pressure to yield 13.5 g of a light yellow powder.

Production Example 2

Synthesis of Example Compound 5

After 24.0 g of o-cresol resin (Example Compound PF8) (average molecular weight 480, 0.05 mol) was dissolved in 500 g of isopropanol at room temperature with stirring, 28.4 g (0.1 mol) of $Ti(i\text{-}C_3H_7O)_4$ was added drop by drop, and this was followed by a reaction at increased temperature under refluxing conditions for 15 hours. After being allowed to cool to room temperature, the reaction mixture was distilled and dried under reduced pressure to yield 32.8 g of a light orange-yellow powder.

Production Example 3

Synthesis of Example Compound 17

After 16.5 g (0.02 mol) of calixresorcinarene (Example Compound CS10) was dissolved in 300 ml of toluene at room temperature, 2.04 g (0.01 mol) of $Al(i\text{-}C_3H_7O)_3$ was added, and this was followed by a reaction under refluxing conditions for 10 hours. After being allowed to cool to room temperature, the reaction mixture was distilled to remove the solvent and dried under reduced pressure to yield 17.0 g of a white powder.

Production Example 4

Synthesis of Example Compound 13

After 6.85 g (0.03 mol) of bisphenol A (Example Compound BS1) was dissolved in 200 g of ethanol, 4.07 g (0.015 mol) of $Zr(OC_2H_5)_4$ was added, and this was followed by a reaction under refluxing conditions for 20 hours. After being allowed to cool to room temperature, the reaction mixture was distilled to remove the solvent and dried under reduced pressure to yield 8.3 g of a white powder.

Production Example 5

Synthesis of Example Compound 21

After 14.2 g (0.03 mol) of bisphenol A-formalin condensate (Example Compound BA7) was dissolved in 300 g of isopropyl alcohol, 4.09 g (0.02 mol) of $Al(i\text{-}C_3H_7O)_3$ was added, and this was followed by a reaction under refluxing conditions for 12 hours. After being allowed to cool to room temperature, the reaction mixture was distilled to remove the solvent and dried under reduced pressure to yield 14.9 g of a white powder.

Production Example 6

Synthesis of Example Compound 28

After 12.98 g (0.01 mol) of t-butylcalix (8) arene (Example Compound CA1) was dispersed in 500 ml of ethanol with potassium carbonate under stirring and thermal refluxing conditions for 30 hours, this dispersion liquid was allowed to cool to room temperature; 4.17 g (0.02 mol) of $Si(C_2H_5O)_4$ was added drop by drop. After a reaction was carried out under refluxing conditions for 3 hours, the reaction mixture was allowed to cool to room temperature, distilled to remove the solvent, and dried under reduced pressure to yield 13.8 g of a white powder.

Next, the toner of the present invention for developing electrostatic images is described in Examples 1 through 5.

Example 1

Styrene-acrylic copolymer resin (HIMER SMB-600, produced by Sanyo Chemical Industries, Ltd.) . . . 100 parts
Carbon Black (MA-100, produced by Mitsubishi Chemical Corporation) . . . 6 parts
Low polymer polypropylene (Biscal 550P, produced by Sanyo Chemical Industries, Ltd.) . . . 3 parts
Example Compound 2 . . . 1.5 parts The above ingredients were uniformly pre-mixed using a high-speed mill to yield a premix, which was then kneaded in a molten slate using an extruder, cooled and thereafter roughly milled using an ultracentrifugal mill. The rough milling product obtained was finely pulverized using an air jet mill and classified by size using a mechanical classifier to yield a black toner 5–15 $\mu$m in particle diameter. Five parts of this toner was admixed with 95 parts of an iron powder carrier (TEFV200/300, produced by Powdertech Co., Ltd.) to yield a two-component developer.

The amount of initial blowoff charges of this developer was determined to be −22.8 $\mu$C/g under low-temperature low-humidity conditions (5° C., relative humidity 30%), −22.4 $\mu$C/g under high-temperature high-humidity conditions (35° C., relative humidity 90%), and −22.5 $\mu$C/g under standard conditions (20° C., relative humidity 60%), demonstrating high stability to environmental changes.

When this toner was used to form toner images using a commercial copying machine, fogging-free high-quality black images with good thin line reproducibility were obtained. Even after 20,000 copies were continuously taken, good black images were obtained with no image density reduction or offset phenomenon.

Example 2

Styrene-acrylic copolymer resin (HIMER SMB-600, produced by Sanyo Chemical Industries, Ltd.) . . . 100 parts
Red dye . . . 6 parts
Low polymer polypropylene (Biscal 550P, produced by Sanyo Chemical Industries, Ltd.) . . . 3 parts
Example Compound 5 . . . 1 part The above ingredients were treated in the same manner as in Example 1 to yield a red toner. Five parts of this toner was admixed with 95 parts of a ferrite carrier (F141-150, produced by Powdertech Co., Ltd.) to yield a two-component developer.

The amount of initial blowoff charges of this developer was determined to be −25.4 μC/g under the low-temperature low-humidity conditions, −25.1 μC/g under the high-temperature high-humidity conditions, and −25.3 μC/g under the standard conditions, demonstrating high stability to environmental changes.

When this toner was used to form toner images using a commercial copying machine, fogging-free high-quality red images with good thin line reproducibility were obtainable. Even after 20,000 copies were continuously taken, good red images were obtained with no image density reduction or offset phenomenon.

Example 3

Styrene-n-butyl methacrylate copolymer resin . . . 100 parts
Benzidine Yellow . . . 6 parts
Low polymer polypropylene (Biscal 550P, produced by Sanyo Chemical Industries, Ltd.) . . . 3 parts
Example Compound 13 . . . 1.5 parts The above ingredients were treated in the same manner as in Example 1 to yield a yellow toner. Five parts of this toner was admixed with 95 parts of a ferrite carrier (F141-150, produced by Powdertech Co., Ltd.) to yield a two-component developer.

The amount of initial blowoff charges of this developer was determined to be −26.0 μC/g under the low-temperature low-humidity conditions, −25.8 μC/g under the high-temperature high-humidity conditions, and −25.9 9 μC/g under the standard conditions, demonstrating high stability to environmental changes.

When this toner was used to form toner images using a commercial copying machine, fogging-free high-quality yellow images with good thin line reproducibility were obtained. Even after 20,000 copies were continuously taken, good yellow images were obtained with no image density reduction or offset phenomenon.

Example 4

Polyester resin (HP-301, produced by The Nippon Synthetic Chemical Industry Co., Ltd.) . . . 100 parts
Blue dye . . . 2 parts
Low polymer polypropylene... 4 parts
Example Compound 16 . . . 1 part The above ingredients were treated in the same manner as in Example 1 to yield a blue toner. Five parts of this toner was admixed with 95 parts of a ferrite carrier (F141-150, produced by Powdertech Co., Ltd.) to yield a two-component developer.

The amount of initial blowoff charges of this developer was determined to be −23.8 μC/g under the low-temperature low-humidity conditions, −23.5 μC/g under the high-temperature high-humidity conditions, and −23.6 μC/g under the standard conditions, demonstrating high stability to environmental changes.

When this toner was used to form toner images using a commercial copying machine, fogging-free high-quality blue images with good thin line reproducibility were obtained. Even after 20,000 copies were continuously taken, good blue images were obtained with no image density reduction or offset phenomenon.

Example 5

Styrene-2-ethylhexyl methacrylate copolymer resin (80/20) . . . 100 parts
Triiron tetraoxide (EPT-500, produced by Toda Kogyo Corporation) . . . 40 parts
Carbon Black (MA-100, produced by Mitsubishi Chemical Corporation) . . . 7 parts
Low polymer polypropylene . . . 4 parts
Example Compound 17 . . . 1 part The above ingredients were uniformly pre-mixed using a ball mill to yield a premix, which was then kneaded in a molten state at 180° C. using a twin-screw extruder (PCM-30, produced by Ikegai Corporation), cooled, thereafter roughly milled, and subsequently finely pulverized and classified by size to yield a one-component toner 5–15, μm in particle diameter. Two parts of this toner was admixed with 98 parts of an iron powder carrier (TEFV200/300, produced by Powdertech Co., Ltd.); the amount of blowoff charges was determined to be −20.9 μC/g.

When this toner was used to form toner images using a commercial copying machine, fogging-free high-quality black images with good thin line reproducibility were obtainable.

Comparative Example 1

A toner and a developer were prepared in the same manner as in Example 1, except that Example Compound 2 was replaced with the following compound [Compound (4) disclosed in Japanese Patent Unexamined Publication No. 139456/1992]. The amount of initial blowoff charges of this developer was determined to be −13.9 μC/g under the low-temperature low-humidity conditions, −6.5 μC/g under the high-temperature high-humidity conditions, and −10.5 μC/g under the standard conditions, demonstrating very low stability to environmental changes.

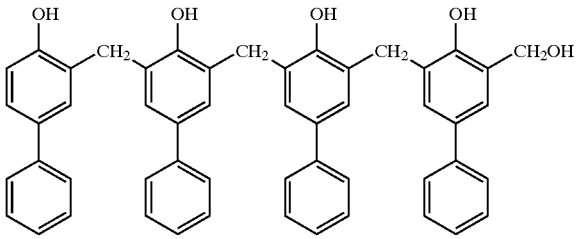

Comparative Example 2

A toner and a developer were prepared in the same manner as in Example 2, except that Example Compound 5 was replaced with the following compound [Compound 2 disclosed in Japanese Patent Unexamined Publication No. 216278/1993]. The amount of initial blowoff charges of this developer was determined to be −16.2 μC/g under the low-temperature low-humidity conditions, −10.2μC/g under the high-temperature high-humidity conditions, and −15.1 μC/g under the standard conditions, demonstrating very low stability to environmental changes.

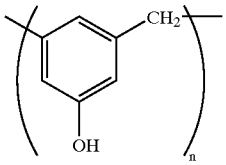

What is claimed is:

1. Charge control agent wherein the active ingredient is a metal compound obtainable by reacting one or two or more molecules of a compound having a phenolic hydroxy group comprising calixresorcinarenes or derivatives thereof; and one or two or more molecules of a metal alkoxide, wherein the metal of the metal alkoxide is at least one metal selected from the group consisting Ti, Al, Zr and Si and the metal alkoxide has the formula $M(OR)_n$ in which M is a said metal, R is a linear or branched alkyl group and n is an integer of 2–4.

2. Charge control agent wherein the active ingredient is a metal compound of the formula I $$(Af)_x(Ld)_y \qquad \text{I}$$

in which each of x and y, whether identical or not, is an integer of 1 or 2 or more;

Af is a compound containing one or two or more aromatic hydrocarbon rings, each of which rings has one or two or more phenolic hydroxy groups or has no phenolic hydroxy groups, provided that when x is 2 or more, all Af are identical or some or all of them are mutually different;

Ld is $(—O—)_rM(OR)_s$ in which M is one or two or more metals selected from the group consisting of Ti, Al, Zr and Si, OR is an alkoxy group, r is an integer of 1 or more, s is an integer of 0 or more, and the sum of r and s is 1 or more, provided that when y is 2 or more, all Ld are identical or some or all of them are mutually different; and each Ld is bound to one or two or more aromatic hydrocarbon rings in Af via the aforementioned —O—, and each Af is bound with one or more Ld compounds, provided that when x is 2 or more, all Af are bound together via Ld;

wherein Af comprises calixresorcinarenes or derivatives thereof.

3. Charge control agent of claim 2 wherein r is an integer of 1–4, s is an integer of 0–3, the sum of r and s is 2–4 and each Ld is bound to 1–4 Af via —O—.

4. Charge control agent of claim 2 wherein R is a linear or branched alkyl group having 1–8 carbon atoms.

5. Toner for developing electrostatic images containing a charge control agent wherein the active ingredient is a metal compound obtainable by reacting one or two or more molecules of a compound having a phenolic hydroxy group comprising calixresorcinarenes or derivatives thereof; and one or two or more molecules of a metal alkoxide, wherein the metal of the metal alkoxide is at least one metal selected from the group consisting of Ti, Al, Zr and Si.

6. Toner of claim 5 wherein the metal alkoxide has the formula $M(OR)_n$ in which M is a said metal, R is a linear or branched alkyl group and n is an integer of 2–4.

7. Toner of claim 5 wherein the alkoxy group in the metal alkoxide is a linear or branched alkoxy group having 1–8 carbon atoms.

8. Toner of claim 5 wherein the toner further contains a binder resin and a coloring agent.

9. Toner for developing electrostatic images containing a charge control agent wherein the active ingredient is a metal compound of the formula I $$(Af)_x(Ld)_y \qquad \text{I}$$

in which each of x and y, whether identical or not, is an integer of 1 or 2 or more;

Af is a compound containing one or two or more aromatic hydrocarbon rings, each of which rings has one or two or more phenolic hydroxy groups or has no phenolic hydroxy groups, provided that when x is 2 or more, all Af are identical or some or all of them are mutually different;

Ld is $(—O—)_rM(OR)_s$ in which M is one or two or more metals selected from the group consisting of Ti, Al Zr and Si, OR is an alkoxy group, r is an integer of 1 or more, s is an integer of 0 or more, and the sum of r and s is 1 or more, provided that when y is 2 or more, all Ld are identical or some or all of them are mutually different; and each Ld is bound to one or two or more aromatic hydrocarbon rings in Af via the aforementioned —O—, and each Af is bound with one or more Ld compounds, provided that when x is 2 or more, all Af are bound together via Ld;

wherein Af comprises calixresorcinarenes or derivatives thereof.

10. Toner of claim 9 wherein r is an integer of 1–4, s is an integer of 0–3, the sum of r and s is 2–4 and each Ld is bound to 1–4 Af via —O—.

11. Toner of claim 9 wherein R is a linear or branched alkyl group having 1–8 carbon atoms.

12. Toner of claim 9 wherein M the toner further contains a binder resin and a coloring agent.

* * * * *